US005954598A

United States Patent [19]

Carlson

[11] Patent Number: 5,954,598

[45] Date of Patent: Sep. 21, 1999

[54] BASEBALL AIMING TRAINER AND METHOD FOR USE

[75] Inventor: Joseph W. Carlson, Pleasant Grove, Utah

[73] Assignee: Edgewise, L.L.C., Centerville, Utah

[21] Appl. No.: 08/848,066

[22] Filed: Apr. 28, 1997

[51] Int. Cl.[6] ..... A63B 69/40

[52] U.S. Cl. ..... 473/458

[58] Field of Search ..... 473/207, 208, 473/212, 213, 216, 215, 231, 458, 464

[56] References Cited

U.S. PATENT DOCUMENTS

| | | | |
|---|---|---|---|
| 1,943,066 | 1/1934 | Ford | 473/239 |
| 3,954,271 | 5/1976 | Treadway | 473/212 |
| 4,300,765 | 11/1981 | Stringham | 273/26 |
| 4,399,994 | 8/1983 | Hourihan | 473/208 |
| 4,746,118 | 5/1988 | Deveney | 273/26 |
| 5,114,142 | 5/1992 | Gillespie et al. | 273/26 C |
| 5,174,575 | 12/1992 | Leith | 473/213 |
| 5,342,055 | 8/1994 | Diley | 473/208 |

*Primary Examiner*—Steven Wong
*Attorney, Agent, or Firm*—Daniel P. McCarthy; Eleanor V. Goodall

[57] ABSTRACT

The present invention is a device for improving hand-eye coordination in a baseball player to improve swing and targeting of the ball. The invention includes a device for presenting a fixed target to the ballplayer which corresponds to the location of the incoming ball at the time that it should be struck by the bat, as well as a method for training the player with the use of this device. In the preferred embodiment of the invention, the target is held in a fixed position with respect to the upper lead arm of the player, by means of a mechanical linkage. The target position is selected by having the player extend his arms as if swinging to hit a ball and placing the marker at the position of the "sweet-spot" of the bat. The player uses the device to practice positioning his body so that the pitched ball consistently hits the target.

9 Claims, 6 Drawing Sheets

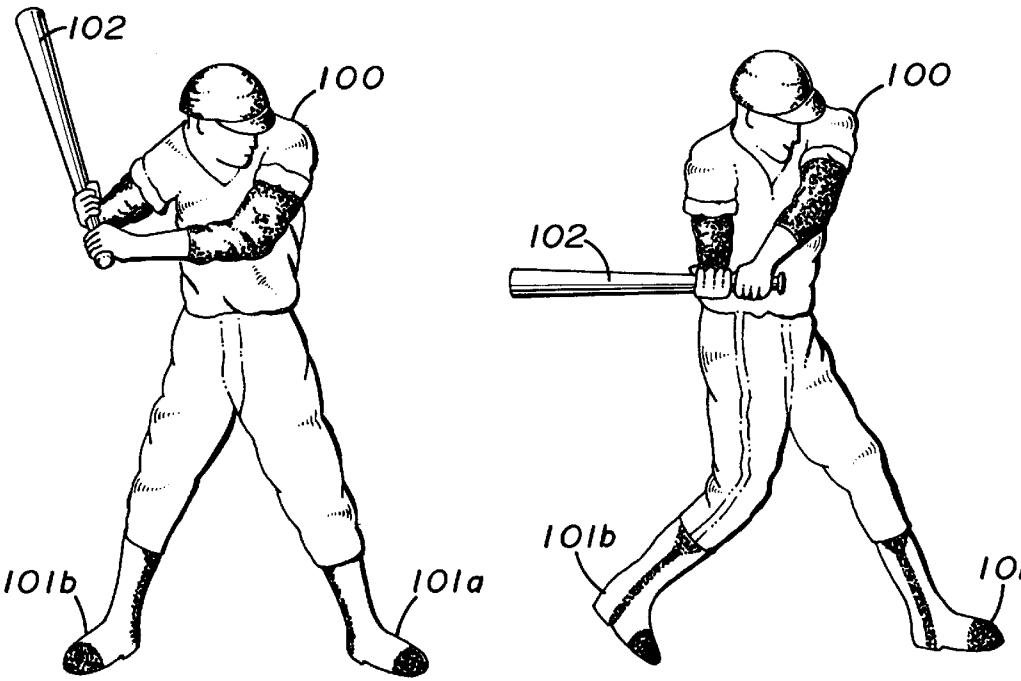
FIG. 1
FIG. 2
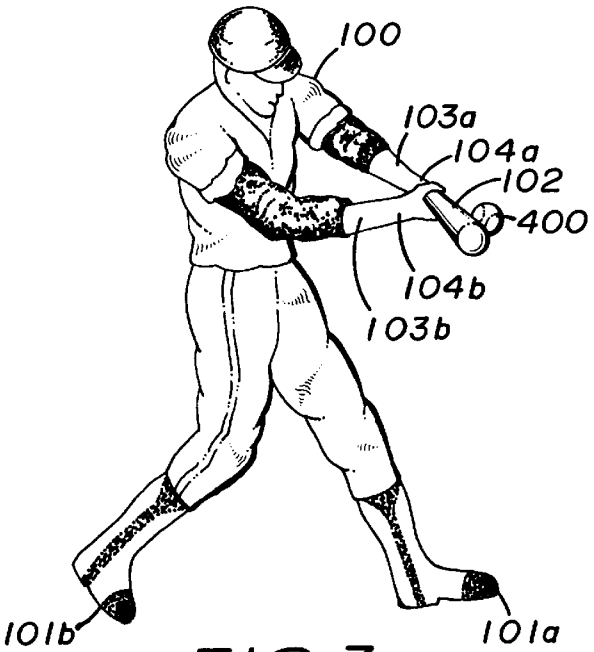
FIG. 3

BASEBALL AIMING TRAINER AND METHOD FOR USE

I. BACKGROUND OF THE INVENTION

A. Field of the Invention

This invention relates to the field of sports training devices, and in particular to devices which are used in training ball players to accurately swing a bat or other striking object at a moving ball. In the preferred embodiment, the invention focuses on the targeting aspects of a swing in order to teach baseball and softball players the correct swing to effectively and repeatedly hit moving baseballs and softballs. The invention improves hand-eye coordination and timing and is particularly directed to training a batter to judge the trajectory of the ball and position the body properly so that the "sweet-spot" of the bat (i.e., the region of the bat that delivers the most impact) strikes the ball.

B. The Background Art

The prior art includes various devices for training athletes. Devices for training baseball and softball players to use a proper swing include that disclosed by Deveney (U.S. Pat. No. 4,746,118, issued on May 24, 1988) and Stringham (U.S. Pat. No. 4,300,765, issued on Nov. 17, 1981), each of which is hereby incorporated by reference in its entirety. The devices disclosed in the Deveney and Stringham patents are used to train the batter to keep his eyes on the ball by keeping his head in a fixed position with respect to his forward shoulder (i.e. shoulder closest to pitcher). Gillespie et al. (U.S. Pat. No. 5,114,142, issued on May 19, 1992) discloses a device which is used to hold the upper or lead arm of a batter close to the body throughout the swing to produce a proper stance. None of these prior art devices solves the problem of training a batter judge the trajectory of the ball and to position or aim his body with respect to an oncoming pitched ball prior to swinging so that the batter ultimately will accurately swing the sweet spot of a bat into the oncoming ball.

II. BRIEF SUMMARY AND OBJECTS OF THE INVENTION

Batting can be broken down into two components: targeting and swinging. During targeting, the batter judges the trajectory of the ball and positions his or her body, and in particular the upper arm and elbow, appropriately; during swinging the batter swings the bat to hit the ball, with the accuracy of the swing dependent on how well the upper arm and elbow were positioned during the previous targeting step. When a batter swings at a baseball, the plane in which the bat is swung is defined by the position of the batter's elbow and upper arm on the lead arm (i.e., the arm on the side closest to the pitcher). It is considered by skilled batters to be preferable to keep the upper lead arm in an essentially fixed position while swinging the bat. At mid-swing (when the bat strikes the ball), the batter's wrist is typically straight, rather than flexed or extended, so that the forearm and bat are roughly parallel. Positioning the upper arm and elbow properly prior to swinging is essential for striking the ball with optimal technique.

The present invention is used to improve batting accuracy by aiding the batter in targeting. The invention accomplishes this by using a mechanical device attached to the batter's upper lead arm which parallels the batter's extended arm and supports a target which is positioned at the point where the sweet-spot of the bat will be when the batter swings through with the bat. After the invention has been attached to the batter and the target positioned, a ball is pitched toward the batter, and the batter moves his arms, elbows and upper body to place the target in the expected path of the ball, at the position where the ball should be hit. If the batter has successfully judged the trajectory of the ball and positioned his body accordingly, the ball will strike the target. The batter need not swing the bat during use of the invention. Once the batter has practiced targeting and positioning with the invention, when he follows through with a swing he should be able to more accurately hit the oncoming ball with the sweet spot of the bat. In the presently preferred embodiment of the invention, the device is attached to the batter's upper arm with a cuff. Other components of the device, including the target, are adjustable so that the device can be used by batters of various sizes and shapes.

One object of the invention is to train a batter to correctly position his leading arm and elbow prior to swinging a bat, thereby enabling him to swing the bat more accurately at a ball. It is a feature of the invention that the batter may locate a target in the region where the sweet spot of his bat will pass, and aim the target at an oncoming ball in order to accurately hit the oncoming ball. It is an advantage of the invention that ball players can be trained to aim a baseball bat by properly positioning their bodies prior to swinging.

Another object of the invention is to train a baseball player to maintain a good batting posture with fully extended arms during the swing. This object is achieved by training the player to position his body appropriately prior to swinging, thereby preparing the player to follow through with a more accurate and forceful swing.

Another object of the invention is to indicate that the batter has successfully judged the trajectory of the ball and positioned his body appropriately by providing a target which will generate a sound or other feedback signal when it is struck by the ball. This object is achieved by the particular materials and design of the invented apparatus.

Another object of the invention is to indicate that the batter has successfully judged the trajectory of the ball and positioned his body appropriately, by providing for the ball to adhere to the target if the ball strikes the target. This object is achieved by the particular materials and design of the invented apparatus.

Another object of the invention is to indicate that the batter has successfully judged the trajectory of the ball and positioned his body appropriately by using as a target a beam of laser light which crosses the trajectory of the ball at the correct position for striking the ball, and providing electronics which produce an audible sound when the laser beam is broken by the ball.

Additional objects, features and advantages of the invention will become apparent to persons of ordinary skill in the art upon reading this specification, and upon reviewing the appended drawings and claims.

III. BRIEF DESCRIPTION OF THE DRAWINGS

FIGS. 1–4 depict proper bat swing and follow through which use of the invention is intended to achieve.

IV. DETAILED DESCRIPTION OF THE PREFERRED EMBODIMENT

The invention is described herein in connection with training a baseball player. It is intended that the invention may be used for the training of softball and baseball players, from amateur Little League players through the professionals in the major leagues, and that the device may be made to be adjustable so that a single device can be used by players of different sizes and shapes. The concept of the invention may be used to train athletes in a variety of arts in which an elongated object is swung toward a moving target. The inventive concept is intended to embrace using the invention and modifications thereof to train athletes in tennis, racquetball, squash, lacrosse, fencing, cricket and other sports in which players need to practice proper swinging toward a moving target.

The fundamental elements of batting are comprised of (1) targeting, (2) timing, (3) strong level swing with wrist snapping action, and (4) follow-through. The batter must spot the ball, calculate its speed and trajectory, and decide whether and how to swing at the pitch in a short amount of time, since the speed of the ball can approach at speeds near 100 miles per hour. The key to successful batting is judging where and when the ball should be hit, and then swinging the bat so that it reaches the desired location at the same time as the ball does. The purpose of the invention is to develop the ball player's targeting and timing skills, and consequently, to improve swing accuracy, so that the ball player will know with confidence that he can reliably place the bat in the path of an oncoming ball. Use of the invention develops in the batter the ability to target and time impact of a bat on a pitched ball, independent of swing and follow-through. By eliminating the variables of swing and follow-through, the batter can practice pitch evaluation and bat aiming in a simplified environment so that his targeting skills will improve.

Figure 4:
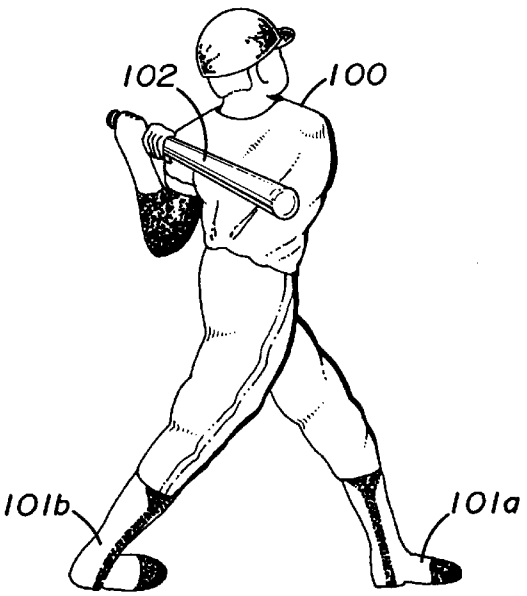

Referring to FIGS. 1–4, proper batting stance, swing and follow-through are depicted. In FIG. 1, a batter 100 is well-prepared to swing at a baseball. The batter's feet 101*a* and 101*b* are firmly planted on the ground, the bat 102 is well cocked, and his eyes are fixed straight ahead to pick up the flight of the pitch. In FIG. 2, the batter 100 is shown having unleashed a level swing. It is crucial that the swing be perfectly targeted and timed in order to connect with the pitched ball. In FIG. 3, a snapshot of the batter's swing at the moment that the bat 102 strikes a pitched ball 400 is shown. It can be seen that the batter's arms 103*a* and 103*b* are opening up in full extension, his wrists 104*a* and 104*b* are snapping the bat 102 in a fast fanning motion, and the spatial orientation of the batter in conjunction with his hand-eye coordination has caused the swung bat to contact a pitched baseball 400. FIG. 4 depicts completion of the swing by follow-through, a crucial element of proper batting form.

Figure 5:
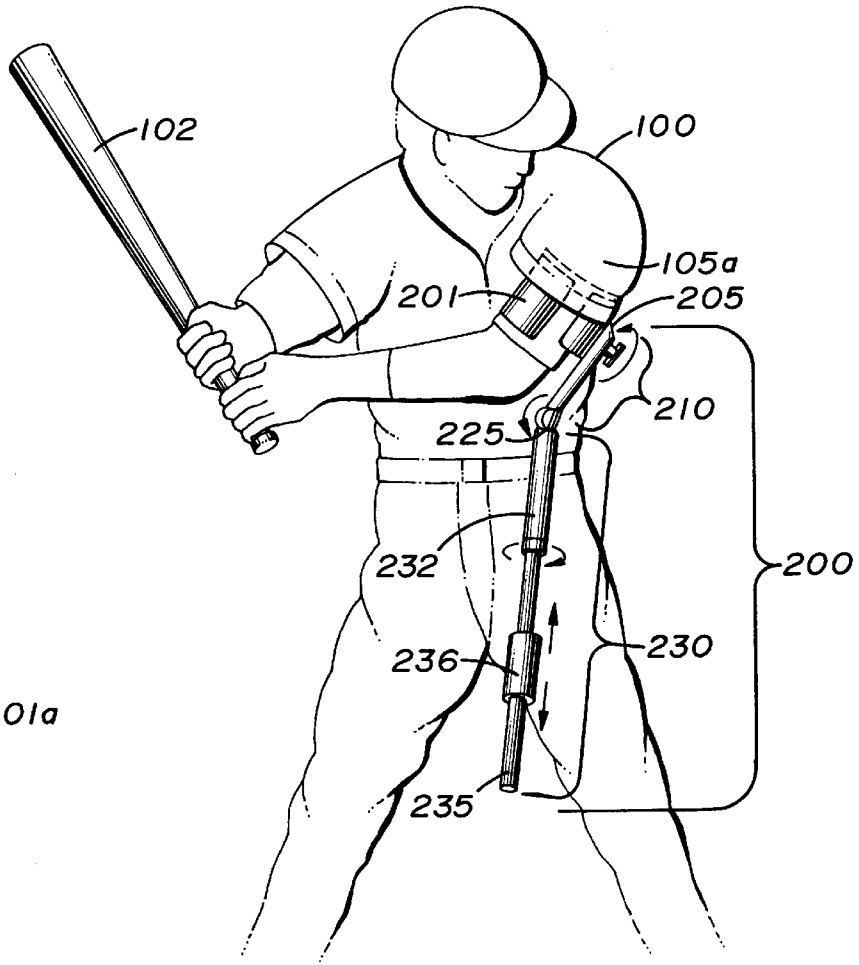
FIG. 5 depicts a front view of a preferred embodiment of the invention in use.

One preferred embodiment of the invented apparatus is shown in FIG. 5. The invented apparatus 200 is referred to herein as a "swing targeting trainer." Swing targeting trainer 200 includes a cuff 201 which fastens the device to upper lead arm 105*a* of batter 100. A first end of elongate member 210 is attached to cuff 201 by adjustable connector 205. Adjustable connector 205 is attached to cuff 201 in such a manner that it is located at the back (triceps) side of the batter's upper arm when cuff 201 is fastened about the batter's upper arm. Telescoping target positioner 230 is movably connected to the second end of elongate member 210 by elbow joint 225.

Telescoping target positioner 230 can be lengthened or shortened by sliding adjusting arm 235 with respect to mount member 232. Target 236 on adjusting arm 235 marks the location at which the bat should intersect the path of the ball. Target 236 can be slid along adjusting arm 235. The position of the device can be adjusted at adjustable connector 205 and elbow joint 225, in order to provide the optimal target positioning for each batter.

Adjustable connector 205 preferably allows elongate member 210 to be adjusted in several ways: first, elongate member 210 can be rotated about connector 205 to adjust the angle between elongate member 210 and the batter's upper arm. Second, elongate member 210 can be rotated about its long axis by up to 100 degrees. Third, elongate member 210 can be slid (translated) with respect to adjustable connector 205 and parallel to the player's upper arm 105*a* to adjust the distance between elbow joint 225 and adjustable connector 205.

Elbow joint 225 allows telescoping target positioner 230 to be rotated about the joint to vary the angle between telescoping target positioner 230 and elongate member 210.

The object of such adjustment is to position telescoping target positioner 230 at an appropriate angle to the batter's body, so that it extends into the area where a ball should be struck—generally directly in front of the batter's body.

Figure 6:
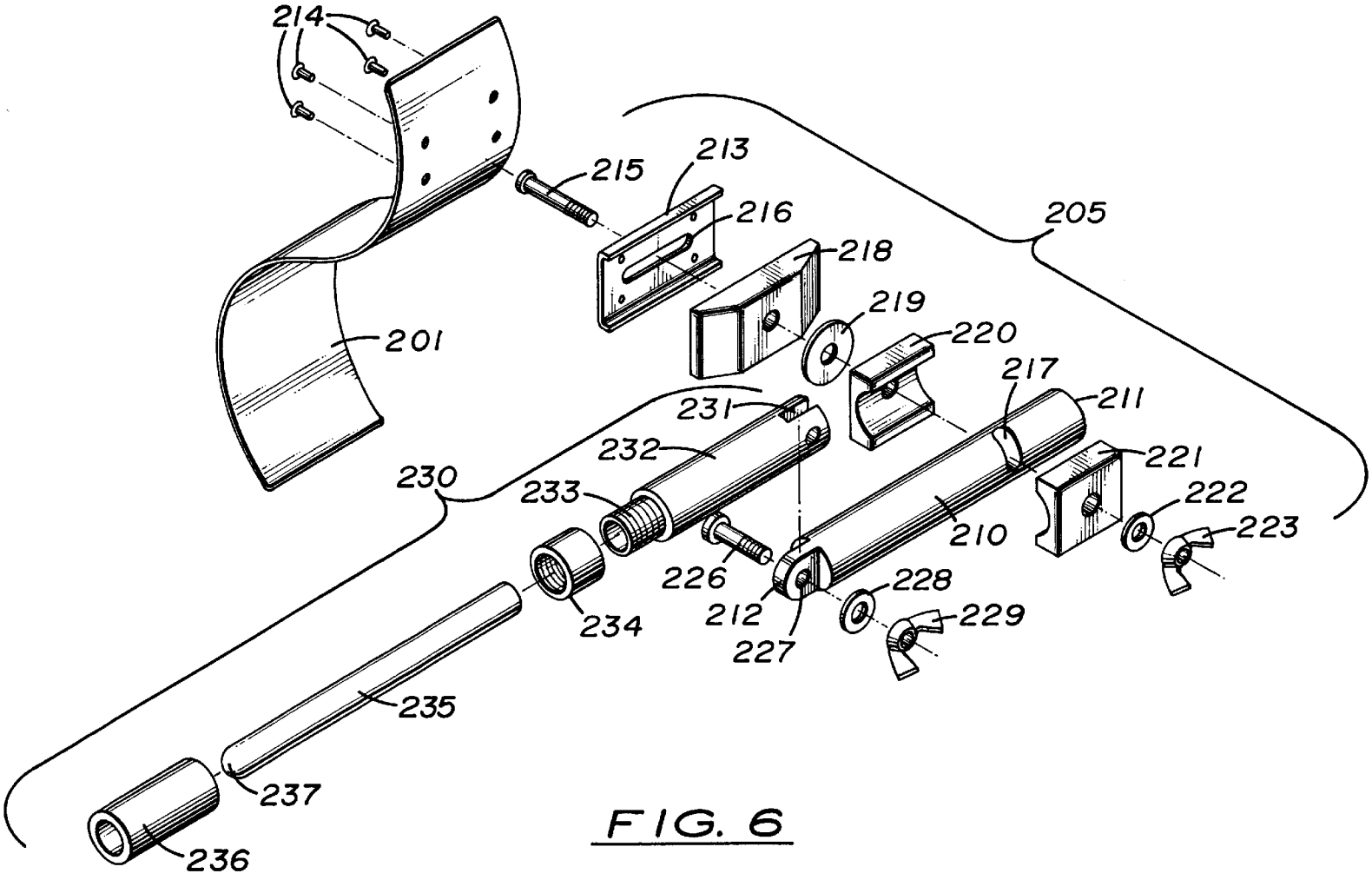
FIG. 6 is an exploded parts diagram of the preferred embodiment of the invention shown in FIG. 5.

The construction of one preferred embodiment of swing targeting trainer 200 is shown in FIG. 6. Cuff 201 is constructed of cloth or other sturdy, flexible material, and is preferably constructed as a tear-away belt of the type typically used on a blood pressure cuff. The tear-away feature of cuff 201 may be implemented using hook and loop fastening means (i.e. "VELCRO"), snaps, or other suitable securing devices. The material of the cuff must be sufficiently rigid that the cuff attaches the swing targeting trainer securely to the batter's upper arm, and may include some type of reinforcing structure, such as struts or stays, to provide sufficient rigidity.

In the preferred embodiment of the invention shown in FIG. 6, adjustable connector 205 is constructed as follows: metal plate 213 is connected to cuff 201 with rivets 214; bolt 215 passes through slot 216 in plate 213, through slidable mount 218, washer 219, inner clamp element 220, slot 217 in first end 211 of elongate member 210, outer clamp element 221, and washer 222, all of which are held together with wing nut 223 which is screwed onto bolt 215. When nut 223 is not fully tightened, the position of elongate member 210 can be adjusted by moving slidable mount 218 with respect to plate 213, to the extent permitted by slot 216; by rotating elongate member 210 with respect to clamp elements 220 and 221 to the extent permitted by slot 217; and by rotating elongate member 210 and clamp elements 220 and 221 together with respect to slidable mount 218 with bolt 215 serving as the axis of rotation. When elongate member 210 has been positioned as desired, nut 223 can be tightened to maintain that position.

Various mechanical components may be used as adjustable connector 205, so long as they provide the desired rotation and translation and allow the device to be held securely in position once it has been adjusted as desired.

First elongate member 210 is preferably constructed of light weight metal, metal alloys, plastic or a composite material, and preferably has a round cross section so that it can be rotated with respect to clamp elements 220 and 221. For adults, the effective length of the elongate member 210) is preferably adjustable to allow elbow joint 225 to be positioned directly over the elbow for batters of various sizes.

The telescoping target positioner 230 is constructed of four separate components in the preferred embodiment of the invention depicted in FIG. 6. These components include mount member 232 which at its first end is attached to elongate member 210 at elbow joint 225. In this embodiment, elbow joint 225 is formed as follows: a slot 231 in the first end of mount member 232 fits over second end 212 of elongate member 210. Bolt 226 fits through holes in said first end of mount member 232 and said second end of elongate member 210, and is fastened with nut 229. A washer 228 is placed between nut 229 and elongate member 210. Elbow joint 225 thus allows rotation of the mount member 232 with respect to elongate member 210, about the axis formed by bolt 226.

Mount member 232 has a threaded region 233 on the outside of its second end so that threaded ring 234 may be screwed onto it. Mount member 232 is constructed as a cylinder with an opening at said second end which allows adjusting arm 235 to be inserted therein. Threaded region 233 on mount member 232 has several slits to allow its walls to compress and tighten around adjusting arm 235 to hold it in place as threaded ring 234 is screwed on. Before threaded ring 234 is tightened, adjusting arm 235 is slidably adjustable within the tubular mount member 232, and threaded ring 234 can lock adjusting arm 235 in any desired position with respect to the mount member 232. Located on adjusting arm 235 is a target 236, which is a hollow cylinder which can be slid along adjusting arm 235.

Mount member 232, threaded ring 234, and adjusting arm 235 are preferably constructed of lightweight metal, metal alloys, plastic or composite materials. Bolts 215 and 226, and nuts 223 and 229 are preferably constructed of metal or metal alloys. Plate 213, sliding mount 218, and clamp elements 220 and 221 are preferably metal, but may also be plastic or composite materials. Washers 219, 222 and 228 may be rubber or knurled or grooved metal to provide better locking at adjustable joint 205 and elbow joint 225. Target 236 is preferably made of plastic or composite materials.

It is desired to adjust the swing targeting trainer 100 so that the target 236 is positioned so that when the batter 100 swings his bat 102, the sweet spot (striking area) of the bat will pass through the area marked by target 236. When the batter has learned to position his body so that the target 236 is in the path of the ball, the batter can be assured that when he swings, the sweet spot or striking area of the bat will pass the area marked by target 236, and assuming that the batter times his swing correctly (i.e. he does not swing the bat too early or too late), the bat will strike the pitched ball.

Figure 8:
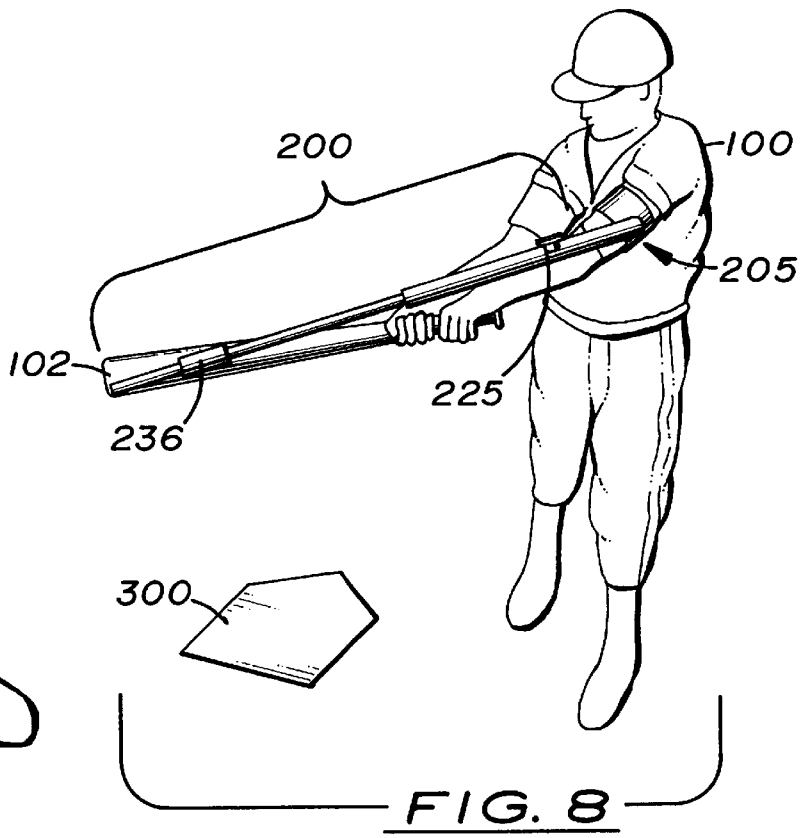
FIG. 8 is a front view of a preferred embodiment of the invention in use with the bat in mid swing.
Figure 7:
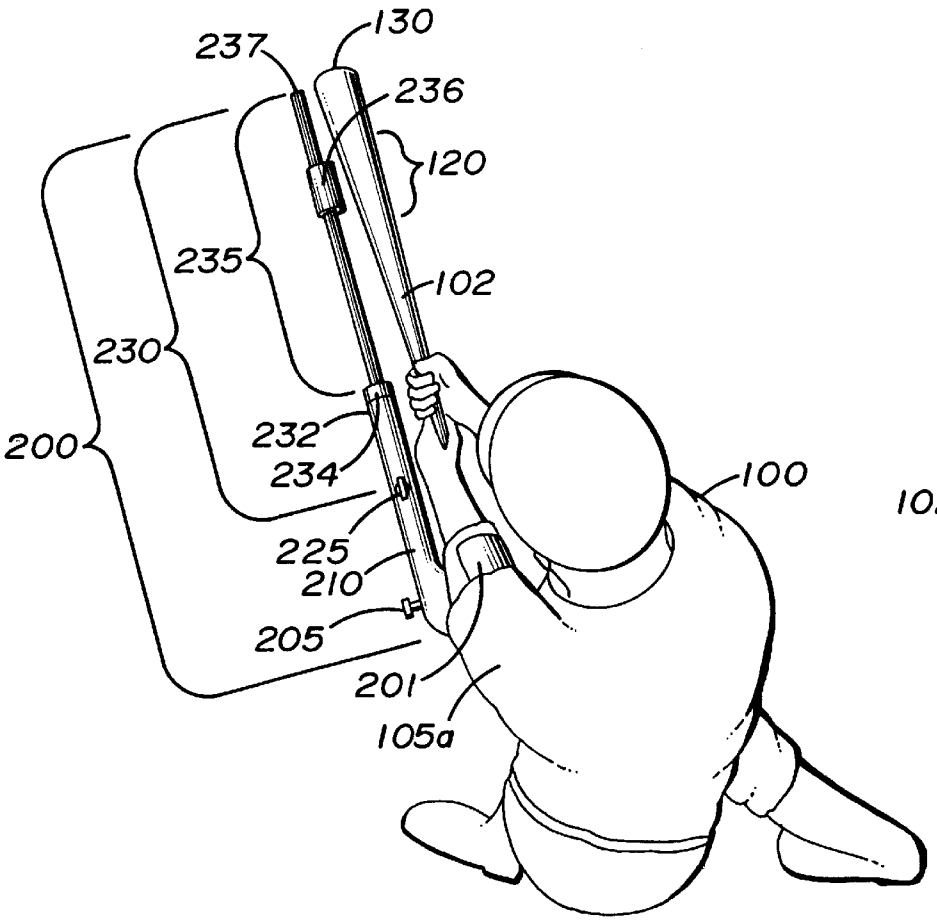
FIG. 7 is a top view of a preferred embodiment of the invention in use with the bat in mid swing.

Referring to FIGS. 7 and 8, it can be seen how the various adjustments of the invented swing targeting trainer 200 can be set for proper use. It should be noted that the objective is to adjust the swing targeting trainer 200 for a particular batter 100 so that the target indicator 236 of the telescoping target positioner 230 is oriented so that it marks the sweet spot (striking area) 120 of the bat 102. First, the swing targeting trainer 200 is attached to the batter's upper lead arm 105*a* by means of cuff 201. The cuff 201 should be attached to the upper arm 105*a* so that the adjustable connector 205 is positioned at the back (i.e triceps) side of the player's upper arm 105*a*. Second, adjustable connector 205, elbow joint 225, and threaded ring 234 are loosened or released to permit adjustment of the adjustable features of the swing targeting trainer 200. Third, the batter 100 should extend the bat 102 into the position shown in FIGS. 7 and 8; that is, the position of a bat 102 when the striking area 120 of the bat 102 connects with a pitched ball. Note that the batter's arms are fully extended. Fourth, the length of the first elongate member 210 is adjusted to position the elbow joint 225 directly over the batter's elbow, and adjustable connector 205 is tightened into place (in the preferred embodiment shown in FIG. 6, by tightening nut 223). Fifth, the telescoping target positioner 230 is adjusted so that the distal end 237 of the adjusting arm 235 extends to the distal end 130 of bat 102. Threaded ring 234 is then tightened to secure the adjusting arm 235 in position with respect to mount member 232. Sixth, the elbow joint 225 is adjusted so that telescoping target positioner 230 is perpendicular to the batter's body and positioned directly over the home plate 300.

The elbow joint 225 is then locked into place in order to preserve the angle between the telescoping target positioner 230 and the first elongate member 210. (In the preferred embodiment depicted in FIG. 6, elbow joint 225 is locked by tightening nut 229). Seventh, target indicator 236 is slid along the adjusting arm 235 so that it is aligned with the striking area 120 of the bat 102. The striking area 120 of the bat 102 is that area of the bat which will transfer the most force to a batted ball, and is commonly referred to as the "sweet spot." It is preferred that the size of the target indicator 236 approximate the size of striking area 120 on bat 102.

In order to improve his batting skill, a batter 100 will adjust the swing targeting trainer 200 as described above and then adopt the batting stance of FIG. 1. Since the swing targeting trainer 200 approximates where the bat 102 will be during full extension of the batter's targeting and target indicator 236 indicates where the sweet spot 120 of the bat 102 will be, the batter 100 can observe oncoming pitched balls, and adjust his stance, arms and elbows to position the target indicator 236 in the path of the oncoming ball. When the batter 100 correctly positions the target 236 in the path of an oncoming ball, the ball should hit the target. This activity helps the batter visualize how to position himself so that when he actually swings the bat to full extension without the device, he can strike the ball at or near the sweet spot of the bat. Once the batter has learned this, his batting without the swing targeting trainer, e.g., in play during games, will be improved.

Because the ball is moving rapidly when it strikes the device, it may not be evident to the batter whether the ball has struck the target or not. Therefore, in some preferred embodiments of the invention, target 236 is designed so that it will give indication that it has been struck by the ball. The target may be made of a resonating material, for example sheet metal, which will emit an audible sound when struck by the ball. Alternatively, the target 236 could have loop fabric located on it, and the ball could have hook fabric on it, (i.e. "VELCRO"), so that the ball, if light enough, would stick to the target 236.

Figure 9:
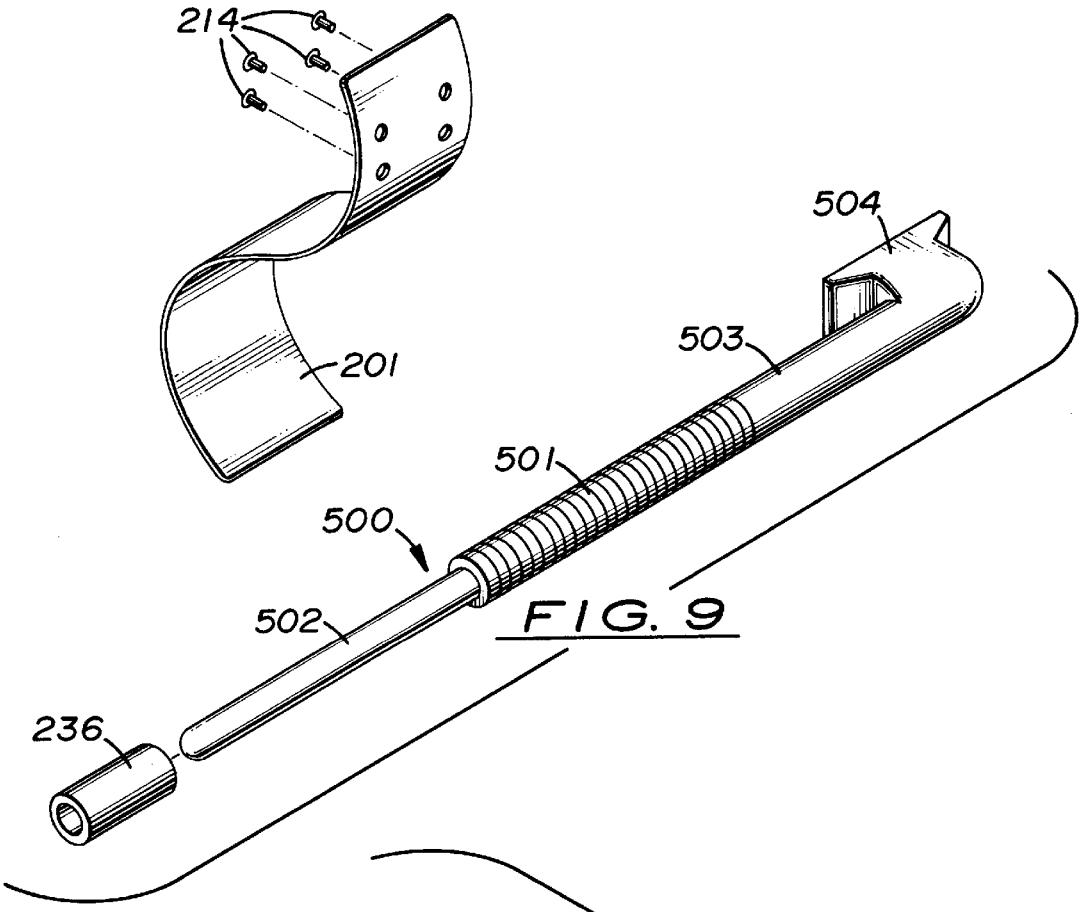
FIG. 9 depicts a simplified alternative embodiment of the invention.

It is contemplated that not all batters will require the fully robust version of the invention depicted in FIGS. 5–8 and described above. A simplified alternative embodiment of the invention is shown in FIG. 9. In this embodiment of the invention, tubular element 500 replaces elongate member 210 and telescoping target positioner 230 shown in FIGS. 5 through 8. Tubular element 500 is constructed of hollow plastic, preferably polyethylene. Adjustability is provided by adjustable connector 205 and elbow joint 225 in the embodiment of the invention presented in FIGS. 5 through 8; in the present embodiment shown in FIG. 9, it is provided by corrugated region 501, which is flexible enough to be bent into position by a ball player, but is sufficiently rigid to hold its configuration when struck by a lightweight ball (such as a hollow plastic ball). Corrugated region 501 allows distal portion 502 of tubular element 500 to be positioned at virtually any desired angle with respect to proximal portion 503. Target 236 slides to any desired position on distal portion 502. Tubular element 500 is attached to cuff 201 by rivets 214 which attach to mounting region 504.

Figure 10:
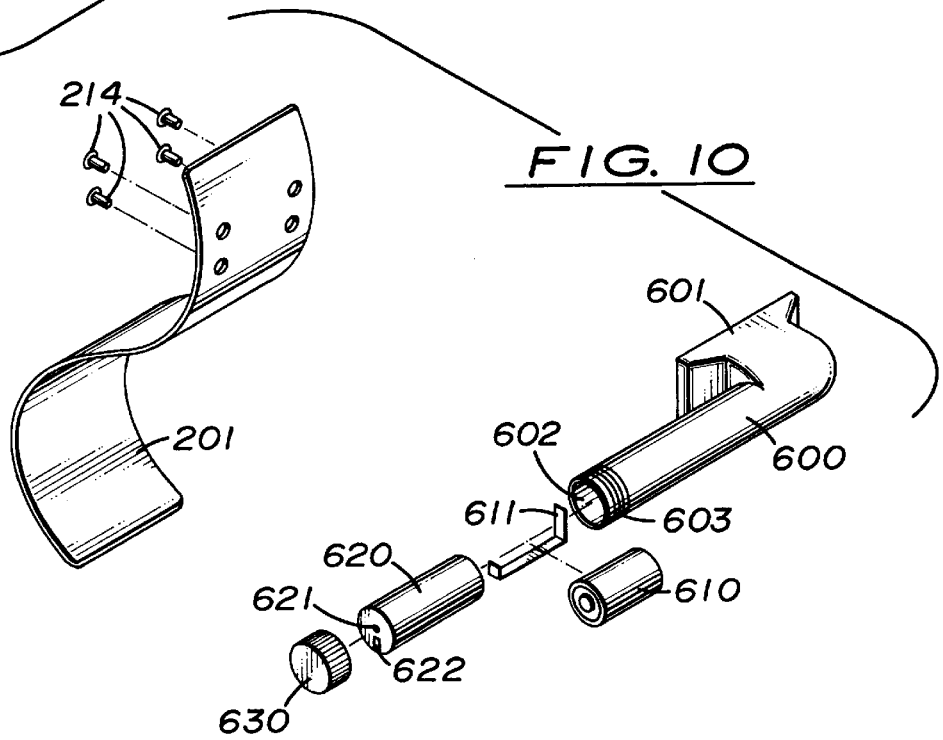
FIG. 10 depicts a further alternative embodiment of the invention.

Yet another embodiment of the invention is shown in FIG. 10. In this embodiment, instead of a physical target supported by a mechanical linkage, a beam of laser light is used as a target. The inventive device is modified so that the laser can be attached to the batter's upper lead arm and directed so that the beam passes through the target region. Laser mount 600 is attached to cuff 201 at laser mount base region 601 by means of rivets 214. Laser mount 600 is hollow and tubular, with one open end 602. The outer region 603 of open end 602 is threaded to receive threaded ring 630. Battery 610, with contact strip 611 fit around it, is inserted into open end 602. Laser 620 is slid into open end 602. Contact strip 611 forms an electrical connection between the negative end of battery 610 and laser 620 and any additional electronics powered by the battery. Laser 620 is a low-power, visible light laser comparable to those used in surveying and distance measurement systems (preferably a Class II diode laser with a wavelength of 670 nM, powered by at least one standard alkaline battery 610). The laser beam exits laser 620 at opening 621. Light detector 622, which is located at the end of laser 620 adjacent to opening 621, detects whether the laser beam has been broken. Light detector 622 is a silicon sensor which produces electrical current as a function of light intensity through the photovoltaic effect. When the baseball passes through the laser beam, a portion of the laser light is reflected back to the light detector, causing an increase in the detector current. The detector current is processed by circuitry to generate a beeping sound when the laser beam is broken. Threaded ring 630 screws onto threaded region 603 to hold battery 610 and laser 620 in place inside laser mount 600. Threaded ring 630 has a lip which holds the battery and laser in place.

Figure 11:
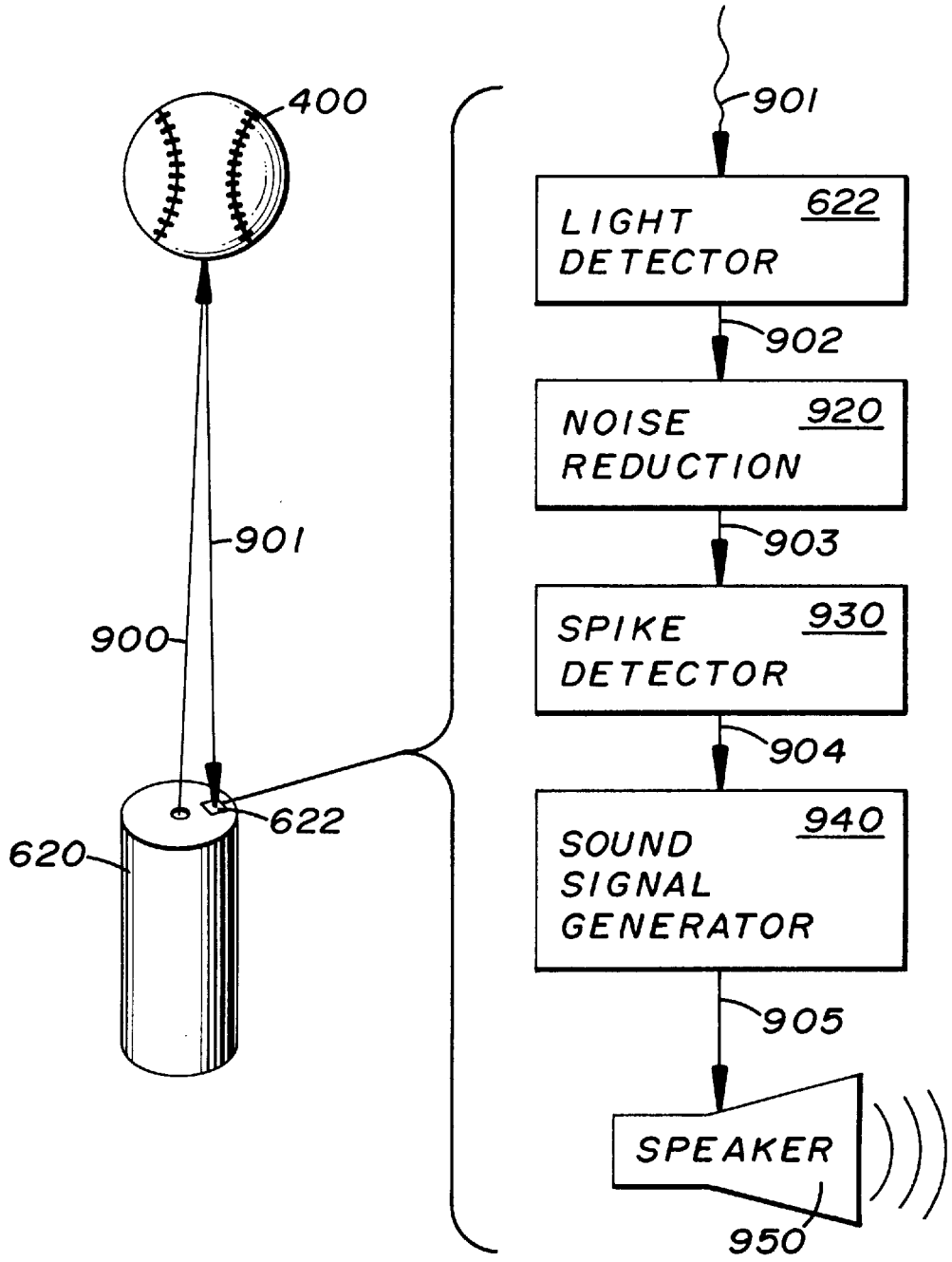
FIG. 11 shows is a block diagram of the electrical circuitry used in the embodiment of the invention shown in FIG. 10.

A schematic diagram of the circuitry used for detecting that the laser beam has been broken and producing a beeping sound is shown in FIG. 11. Laser beam 900 is generated by laser 620. Laser beam 900 bounces off baseball 400 and at least a portion is reflected back to light detector 622 as reflected laser beam 901. Light detector 622 is mounted adjacent to opening 621, either on the face of laser 620 as shown in FIG. 10, or next to the laser. Detector current 902 is an electrical current produced by light detector 622. Detector current 902 is a function of the light entering light detector 622. Current 902 therefore is generated in response to ambient light as well as to reflected laser beam 901. Noise reduction circuitry 920 is used to filter out the components of the signal (current 902) due to ambient light (a relatively unchanging signal) and other noise sources, leaving the transient signal caused by the light reflected by the baseball as it passes through the laser beam. Filtered signal 903 is processed by spike detection circuitry 930, which detects the occurrence of the transient "spike" caused by the baseball. The output of spike detection circuitry 930, spike signal 904, is fed into sound signal generator 940, which produces a audio driving signal 905 (e.g. a pulsed sinusoid) suitable for driving speaker 950 to produce an audible beeping sound when the baseball is detected. The electronic circuitry is battery powered, as is the laser. The electronic circuitry can be constructed out of discrete components, or built on a chip, as depicted in FIG. 10. If the electronic circuitry is built onto a chip, the entire chip may be mounted at the end of the laser. If discrete components are used, light detector 622 is mounted at the end of the laser adjacent to opening 621, but the remainder of the circuitry may be located inside laser mount 600.

The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A method for training a batter to evaluate a pitched ball and to target a bat having a sweet spot at a flight path of a pitched ball, the method comprising the following steps:

(a) acquiring a targeting trainer, the targeting trainer including:

(i) a cuff for mounting said targeting trainer to a batter's upper lead arm, (ii) an adjustable connector attachable to said cuff, (iii) a first elongate member having a first end and a second end, said first elongate member first end being attachable to said cuff by said adjustable connector, said first elongate member being angularly adjustable with respect to said cuff by adjusting said adjustable connector, (iv) a target positioner having a first end and a second end, said target positioner first end being attachable to said first elongate member second end at a pivotal elbow joint and said target positioner second end being slidable toward and away from said target postioner first end, and (v) a target locatable at a variety of locations on said telescoping target positioner and which is used to represent a sweet spot of a bat and to aim at an expected arrival location of a pitched ball, (c) mounting said targeting trainer on a batter's upper lead arm, (d) adjusting said targeting trainer so that said target is located in a region where a pitched ball should be struck in an area in front of the body of a batter to whose arm said targeting trainer is attached, (e) positioning the batter's body and stance of the batter so that said target may be aimed and located where a pitched ball will travel.

2. A method as recited in claim 1 wherein said target positioner is length-adjustable by a telescoping mechanism.

3. A method as recited in claim 1 wherein said target positioner is angularly adjustable with respect to said first elongate member.

4. A method as recited in claim 1 wherein said adjusting step (d) comprises:

(i) rotating said first elongate member about said adjustable connector to achieve a desired angle of said first elongate member with respect to said cuff and with respect to the batter's upper arm, (ii) angling said target positioner with respect to said first elongate member to achieve a desired angle between said target positioner with respect to said first elongate member, and (iii) sliding said target along at least a portion of the length of said target positioner so that said target is located in a region where a pitched ball should be struck in an area in front of a the body of the batter to whose arm said targeting trainer is attached.

5. A baseball targeting trainer comprising:

(a) a cuff for mounting said targeting trainer to a batter's upper lead arm, (b) an adjustable connector attached to said cuff and adapted to receive and firmly hold an elongate member, said adjustable connector having a slot therein to provide longitudinal adjustment of an elongate member with respect to said adjustable connector, said adjustable connector also having a rotational adjustment mechanism to permit angular adjustment of an elongate member with respect to said adjustable connector by angular rotation of an elongate member with respect to said adjustable connector, and said adjustable connector also having a mechanism that accommodates axial rotation of an elongate member with respect to said adjustable connector with respect to said adjustable connector, (c) an elongate member having a first end and a second end, said elongate member first end being adjustably attached to said cuff by said adjustable connector, (d) a target positioner having a first end and a second end, said target positioner first end being attached to said first elongate member second end, (e) an elbow joint located at the attachment location of said target positioner to said elongate member, said elbow joint providing said target positioner with the ability to be angularly adjusted with respect to said elongate member, and (f) a target locatable at a variety of locations on said target positioner, said target serving to represent a sweet spot of a bat and said target being usable by a batter to aim at an expected arrival location of a pitched ball.

6. A baseball targeting trainer as recited in claim 5 wherein said target positioner is longitudinally adjustable with respect to said elongate member.

7. A baseball targeting trainer as recited in claim 5 wherein said cuff comprises hook and loop fastening means for being fastened to an upper arm of a batter.

8. A baseball targeting trainer as recited in claim 5 further comprising:

(g) means for accommodating rotational adjustment of said elongate member about said adjustable connector to achieve a desired angle of said elongate member with respect to said cuff and with respect to a batter's upper arm, (h) means for angling said target positioner with respect to said elongate member to achieve a desired angle between said target positioner with respect to said elongate member, and (i) means to accommodate sliding said target along at least a portion of the length of said target positioner so that said target is located in a region where a pitched ball should be struck in an area in front of the body of a batter to whose arm said targeting trainer is attached.

9. A baseball targeting trainer comprising:

(a) a cuff for mounting said targeting trainer to a batter's upper lead arm, (b) an adjustable connector attached to said cuff and adapted to receive and firmly hold an elongate member, (c) an elongate member having a first end and a second end, said elongate member first end being adjustably attached to said cuff by said adjustable connector, (d) a target positioner having a first end and a second end, said target positioner first end being attached to said first elongate member second end, (e) an elbow joint located at the attachment location of said target positioner to said elongate member, said elbow joint providing said target positioner with the ability to be angularly adjusted with respect to said elongate member, and (f) a target locatable at a variety of locations on said target positioner, said target serving to represent a sweet spot of a bat and said target being usable by a batter to aim at an expected arrival location of a pitched ball.

* * * * *